United States Patent [19]

Wallace

[11] Patent Number: 4,653,637

[45] Date of Patent: Mar. 31, 1987

[54] FOLD-UP RACK FOR SCREWDRIVERS AND THE LIKE

[75] Inventor: Clyde R. Wallace, Cheraw, S.C.

[73] Assignee: The Stanley Works, New Britain, Conn.

[21] Appl. No.: 745,537

[22] Filed: Jun. 17, 1985

[51] Int. Cl.[4] ..... B65D 85/24

[52] U.S. Cl. ..... 206/372; 206/577; 211/60.1; 211/70.1; 211/70.6; 248/205.3

[58] Field of Search ..... 206/577, 230, 231, 234, 206/223, 372, 373, 575; 211/88, 87, 60.1, 70.6, 70.1, 104; 248/205.3

[56] References Cited

U.S. PATENT DOCUMENTS

| | | | |
|---|---|---|---|
| Re. 24,889 | 10/1960 | Tupper . | |
| 1,170,231 | 2/1916 | Flint . | |
| 1,670,204 | 5/1928 | Moore . | |
| 1,890,181 | 12/1932 | Hoffman | 206/489 |
| 2,526,732 | 10/1950 | Cogsdill . | |
| 2,767,711 | 10/1956 | Ernst . | |
| 2,813,625 | 11/1957 | Seyforth | 206/231 |
| 2,823,249 | 2/1958 | Curtiss . | |
| 2,959,296 | 11/1960 | Case . | |
| 3,002,630 | 10/1961 | Heisser . | |
| 3,204,813 | 9/1965 | McCuskey et al. . | |
| 3,259,230 | 7/1966 | Jaeger . | |
| 3,269,529 | 8/1966 | Hume . | |
| 3,516,585 | 6/1970 | Inwood . | |
| 3,549,064 | 12/1970 | Wilson . | |
| 3,575,290 | 4/1971 | Stork | 206/577 |
| 3,603,551 | 9/1971 | Peterson . | |
| 3,685,660 | 8/1972 | Saunders | 211/70.1 |
| 4,043,453 | 8/1977 | Greenlee | 211/70.6 |
| 4,071,212 | 1/1978 | Burrows et al. . | |
| 4,082,201 | 4/1978 | Bittel . | |
| 4,275,862 | 6/1981 | Takagi et al. | 248/205.3 |
| 4,343,172 | 8/1982 | Nordlund | 211/70.1 |

FOREIGN PATENT DOCUMENTS

| | | | |
|---|---|---|---|
| 737581 | 12/1932 | France | 211/70.6 |
| 1489463 | 10/1977 | United Kingdom | 211/70.6 |
| 992333 | 1/1983 | U.S.S.R. . | |

*Primary Examiner*—William Price
*Assistant Examiner*—Brenda J. Ehrhardt

[57] ABSTRACT

An integrally formed, generally planar plastic member is capable of being erected into a tool rack. The member is desirably packaged along with the set of tools for which it is intended.

6 Claims, 11 Drawing Figures

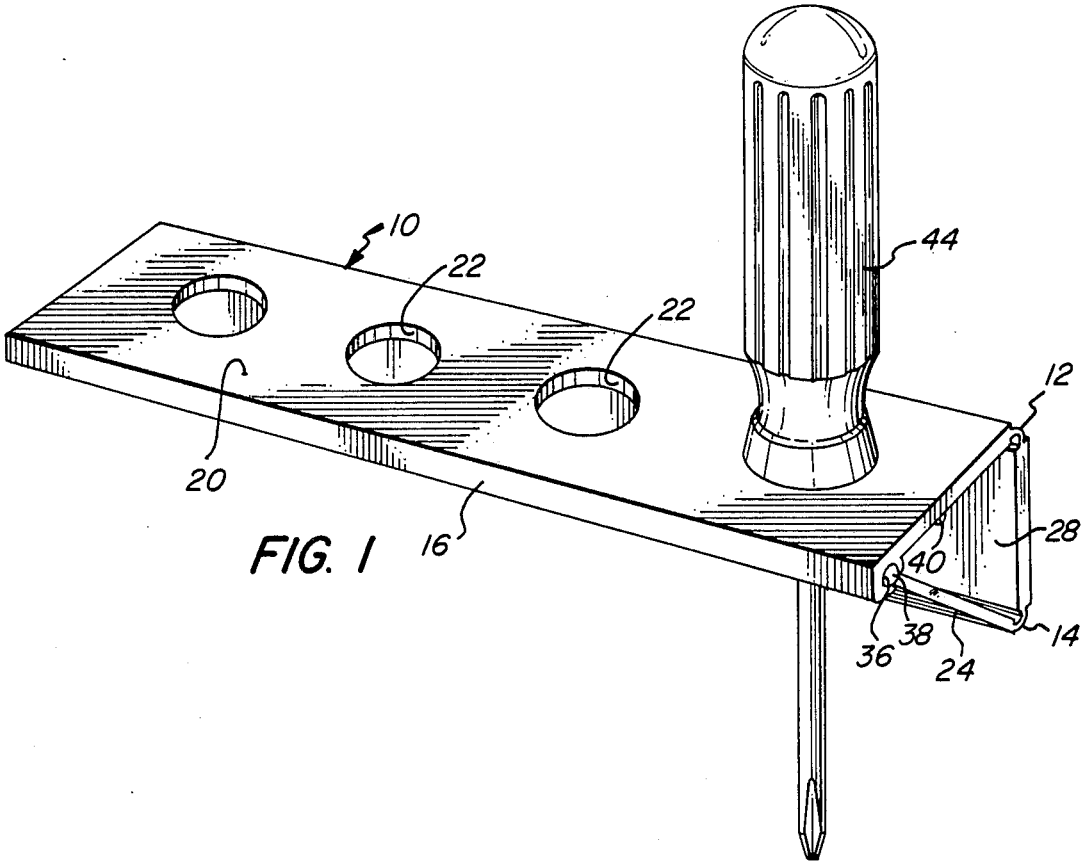
FIG. 1
FIG. 2
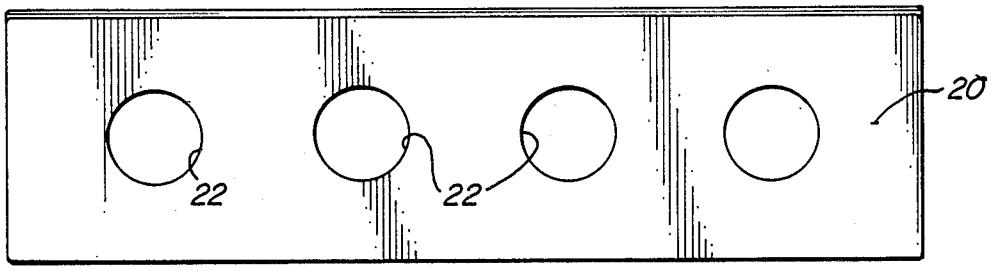
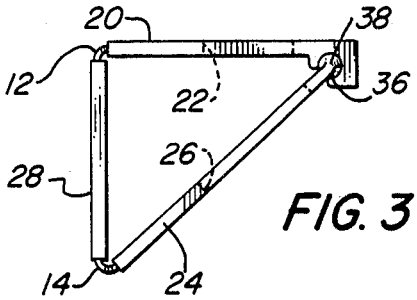
FIG. 3

FOLD-UP RACK FOR SCREWDRIVERS AND THE LIKE

BACKGROUND OF THE INVENTION

Screwdrivers and similar tools are commonly offered for sale in prepackaged sets, consisting of several different types and/or sizes. In some instances, the tools are packaged in a rigid container, designed for subsequent use by the consumer for storage purposes. Such packaging is not always the most desirable form, however, and may entail excessive difficulty and expense from the standpoint of manufacture, product loading, assembly, etc. Nevertheless, it remains advantageous to provide means for storage of the tools by the consumer in a neat and well-organized manner.

Many forms of racks have been disclosed in the prior art for supporting a variety of objects, typical of which are those described in the following United States patents A step-like holder for toothbrushes is shown in Flint U.S. Pat. No. 1,170,231; it is of rigid construction, has a number of openings for receiving the toothbrush handles, and is adapted to be secured to a wall.

Heisser U.S. Pat. No. 3,002,630 also describes a toothbrush rack, consisting of a folded, generally rectangular card mounted within grooves formed in a cooperating bracket; each of several slots at the apex of the card is configured to engage a toothbrush.

A tool holding device is taught in Peterson U.S. Pat. No. 3,603,551, which consists of a thick resilient member carried by a rigid, generally L-shaped support; the resilient member has slitted areas aligned with openings in the support member, providing inwardly tapered segments for yieldably gripping the shank of an inserted tool.

U.S. Pat. No. 4,071,212 to Burrows et al describes a rack having a U-shaped section which is slotted to receive the several knives of a set.

Despite the foregoing, a need remains for an effective and yet relatively inexpensive tool rack that can be packaged in a flat condition, along with a set of tools, and is adapted to be erected by the purchaser for subsequent storage use.

Accordingly, it is a broad object of the present invention to provide a novel article of generally planar construction, which can readily be erected to form a rack for storage of objects, particularly a set of tools, in a neat and well-organized manner.

It is also an object of the invention to provide such an article which is relatively inexpensive and facile to manufacture, and is yet strong, durable, and highly effective for its intended utility.

Another object of the invention is to provide a novel package comprised of an article having the foregoing features and advantages, together with a plurality of tools or other objects to be supported thereby.

SUMMARY OF THE INVENTION

It has now been found that certain of the foregoing and related objects of the invention are readily attained by the provision of a generally planar member divided, by longitudinally spaced, laterally extending hinge elements, into a supporting section, a bracing section, and a mounting section therebetween. The member has means for interengaging, in its erected form, the supporting and bracing sections, in positions folded inwardly about the mounting section. The supporting section has a plurality of openings extending through it, and the bracing section is configured to cooperate therewith, for individual support of each of several objects. Thus, the member can be erected into a rack for supporting a plurality of objects, such as a set of screwdrivers.

Generally, each of the sections of the planar member will be of generally rectangular peripheral configuration, and the hinge elements will extend thereacross generally parallel to the edges at the opposite ends of the member. The bracing section will normally also have a plurality of openings, disposed to align with the openings of the supporting section, in the erected form of the member. The interengaging means employed will advantageously comprise tongue and groove elements on the supporting and bracing members, to enable snap-fitting interengagement. Preferably, the groove element will be disposed along the free outer edge of the supporting section at one end of the planar member, and the tongue element will comprise the free outer edge of the bracing section, at the opposite end thereof. The mounting section will usually have apertures or other means for attaching the member to supporting structure, and the entire member will most desirably be integrally formed from a single piece of synthetic resinous material.

Other objects of the invention are achieved by the provision of a package of objects which comprises, in addition to the generally planar member herein described, a backing board, a plurality of objects, and removable means for maintaining the board, objects and planar member in assembly. The removable means will normally comprise a film of synthetic resinous material wrapped about the other components of the package.

BRIEF DESCRIPTION OF THE DRAWINGS

FIG. 1 is a perspective view of an article embodying the present invention, erected into triangular form to provide a rack for supporting four objects, such as the screwdriver shown;

FIG. 2 is a plan view of the rack shown in FIG. 1;

FIG. 3 is an end view of the rack, taken from the left-hand side of FIG. 1;

DETAILED DESCRIPTION OF THE ILLUSTRATED EMBODIMENTS

Figure 9:
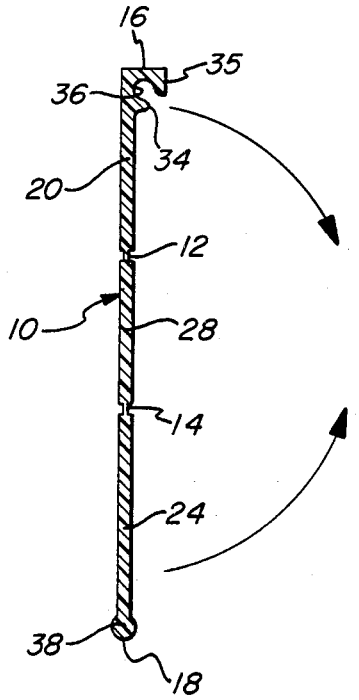
FIG. 9 is a sectional view of the member of FIG. 8, taken along line 9—9 thereof.
Figure 10:
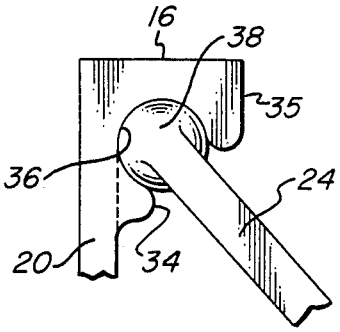
FIG. 10 is a fragmentary end view of the upper forward edge of the erected rack, as folded from the position of the planar member shown in FIG. 9, and drawn to a greatly enlarged scale.

Turning now in detail to FIGS. 1–10 of the drawings, therein illustrated is an article embodying the present invention, folded and erected into a supporting rack in FIG. 1–7 and 10. As perhaps best seen in FIGS. 8 and 9, however, the article is comprised of a member, generally designated by the numeral 10, which is substantially planar and of substantially rectangular peripheral configuration. It is divided into three generally rectangular sections by a pair of longitudinally spaced, laterally extending hinge elements 12, 14, which are parallel to the edges 16, 18, at the opposite ends of the member 10; as is best seen in FIG. 9 the hinge elements comprise areas of reduced cross section, formed into the material of which the member 10 is fabricated.

The section 20 serves as the upper wall of the erected rack, and is formed with four circular openings 22. The section 24 at the opposite end of the member 10 functions as a bracing piece, and is similarly formed with a corresponding number of oblong openings 26, which underlie the openings 22 and align therewith in the erected form.

The intermediate section 28 is hingedly connected along its opposite edges to the sections 20, 24, and is provided with a pair of small apertures 30 adjacent the lateral edges 32 of the member 10. The apertures serve to receive fasteners, such as the screw 40 shown in FIG. 7, for mounting the rack upon a wall 42 or similar supporting structure.

The member has three rectilinear rib formations 34, which extend parallel to and adjacent the edge 16; they cooperate with the overhanging, continuous ledge element 35 to form three elongated groove sections 36 of semicircular cross section. The opposite edge 18 of the member is enlarged to provide a bead 38 extending across the entire width thereof, the bead also being of generally circular cross-sectional configuration and dimensioned to engage, in a snap-fitting manner, within the groove sections 36.

From the foregoing, the manner by which the member 10 is formed into the rack shown in the several figures of the drawings will be readily apparent. As suggested by the arrows in FIG. 9, it is simply a matter of folding the section 20 about the integral hinge 12 to a substantially right-angular orientation with respect to the mounting section 28, folding the bracing section 24 about the hinge 14 to a diagonal position, and snapping the bead 38 into the groove section 36 to effect secure interengagement. Obviously, the lengths of the three sections (i.e., along an axis extending between the edges 16, 18 of the member 10) will be proportioned so as to cause the supporting section 20 to lie in the desired relationship to the mounting section 28.

Figure 4:
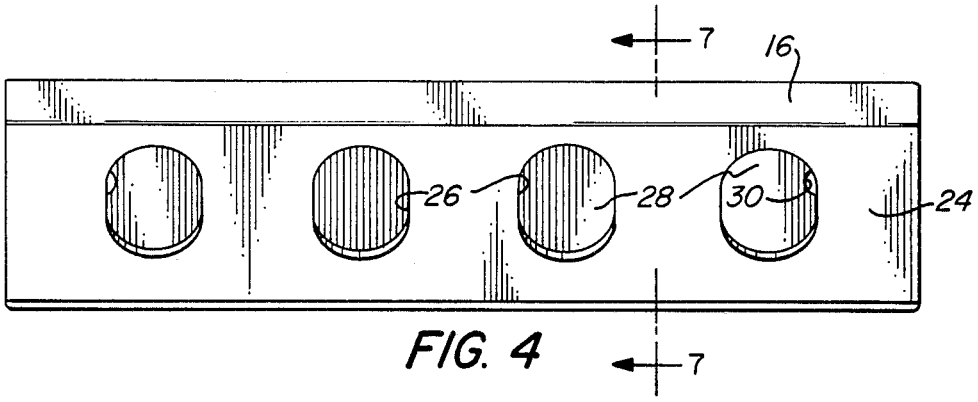
FIG. 4 is a front view of the rack.
Figure 5:
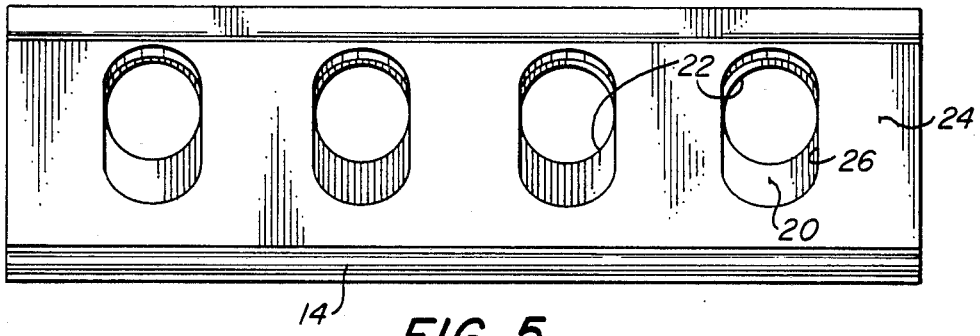
FIG. 5 is a bottom view of the rack.
Figure 6:
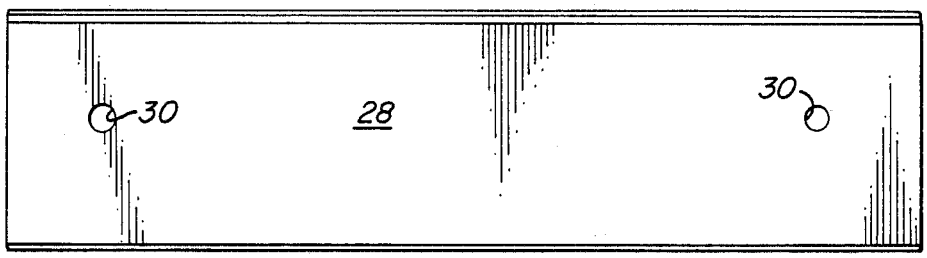
FIG. 6 is a rear view of the rack.
Figure 7:
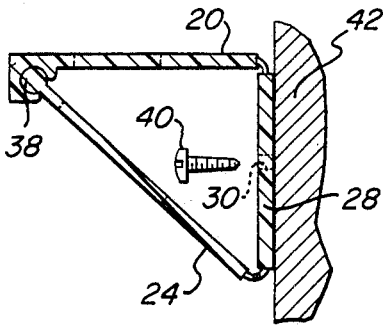
FIG. 7 is a sectional view of the rack, taken along line 7—7 of FIG. 4.
Figure 8:
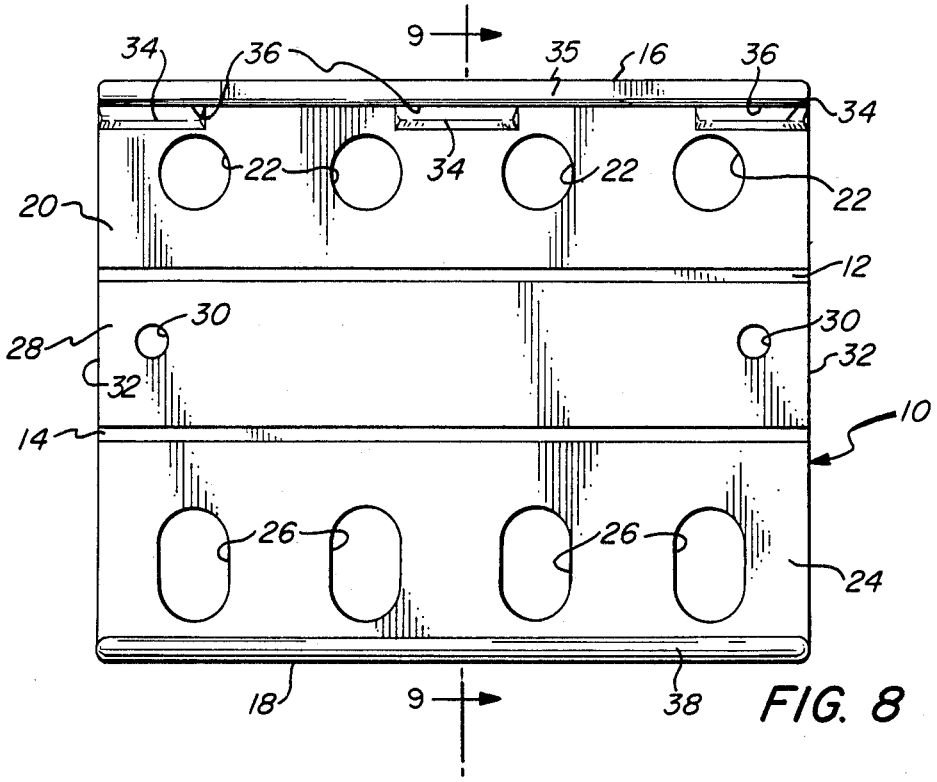
FIG. 8 is a plan view of the planar member comprising the article, in flat condition.

As indicated in FIG. 7, the section 20 of the rack will normally be mounted in a horizontal position (i.e., extending generally perpendicularly to the wall 42). Thus, the rack will be suitably disposed to support a screwdriver 44 by inserting its blade portion downwardly through the vertically aligned openings 22, 26, as shown in FIG. 1.

Figure 11:
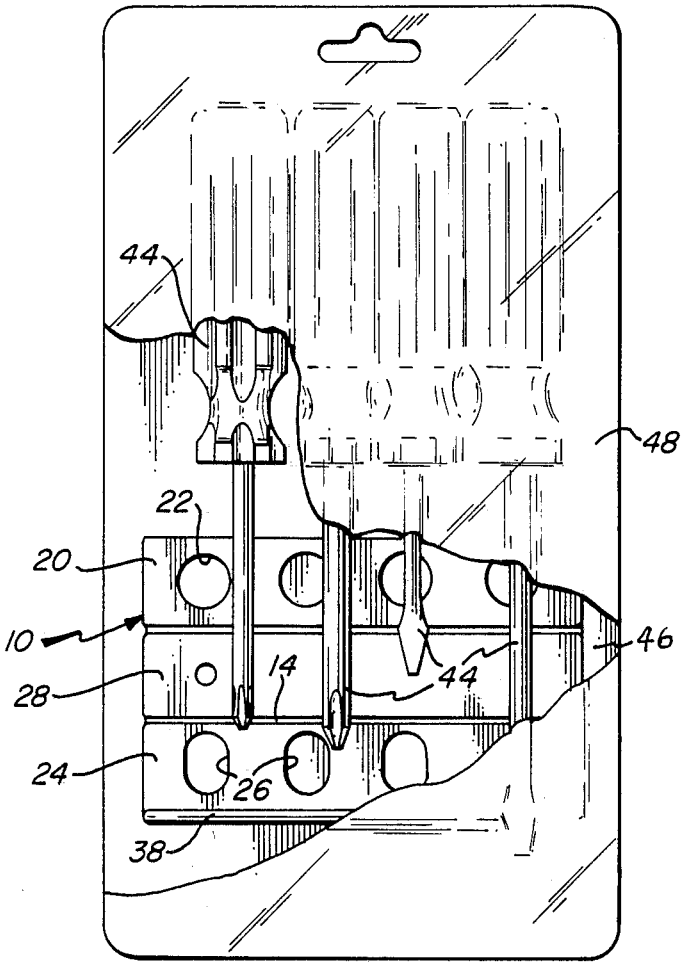
FIG. 11 is a fragmentary plan view of a package embodying the present invention, showing the side of the rack-forming article opposite to that shown in FIG. 8.

Turning now to FIG. 11 of the drawings, a package embodying the invention is shown which includes, in addition to the planar member 10 from which the rack is formed, four different screwdrivers 44, a backing board 46, and a covering film 48 of plastic; other items, such as fasteners for mounting the rack, may also be enclosed. As will readily be appreciated, the package is produced simply by positioning the planar member 10 in superposed relationship with the backing board 46, arranging the screwdrivers 44 on the planar member 10, and finally applying a wrapping of the film 48 about the assembly, all of which can be done automatically. The film may be applied simply as an overwrap, or it may be heat-shrunk to provide a tighter package. Other forms of packaging may of course be employed without departing from the scope of the present claims, such as the more rigid blister pack-type of assemblies.

It will be appreciated that structure of the planar member may vary widely; for example it, and /or its several sections, may be formed with non-rectangular configurations. Moreover, although it will generally be desirable to employ full-width panels for the mounting and bracing sections of the rack, to provide maximum strength, they may instead comprise strips of hingedly connected elements spaced along the width of the supporting section 20.

The openings 22 in the upper supporting wall may of course take a wide variety of forms and dimensions, as may best be suited to seat the particular objects for which the rack is intended. In this regard, it should be clear that the present invention is not limited to the provision of members for supporting tools, or of packages comprising them; similar articles may be useful for other objects, such as toothbrushes.

The variations possible in the interengaging means used to secure the supporting section to the bracing section will be self-evident, and need not be discussed in detail. Although the interfitting tongue-and-groove arrangement illustrated is particularly advantageous from the standpoint of simplicity and facility of manufacture, other elements may be equally or more desirable in certain circumstances. It might be pointed out that the interengaging structure employed is not considered novel per se, and similar features are shown in the prior art on other articles (e.g., for the package assembly of Ernst U.S. Pat. No. 2,767,711, and for the snap-on pigtail connector of Curtiss U.S. Pat. No. 2,823,249).

Suitable materials of construction will also be evident to those skilled in the art. Suffice to say that, although synthetic resins will generally afford optimal durability and strength at low cost, heavy duty cardboard or corrugated paperboard construction may for example be employed in certain instances.

Thus, it can be seen that the present invention provides a novel article, of generally planar construction, which can readily be erected to form a rack for storage of objects in a neat and well-organized manner. The article is relatively inexpensive and facile to manufacture, particularly because the tooling required is relatively simple, and is yet strong, durable and effective for its intended utility. The invention also provides a novel package comprised of the foregoing article, together with a plurality of tools or other objects to be supported thereby.

Having thus described the invention, what is claimed is:

1. An article adapted to be erected to form a rack for supporting a plurality of screwdrivers or like objects on a wall or other vertical surface, comprising a generally planar member divided by longitudinally spaced, laterally extending hinge elements into a supporting section, a bracing section, and an intermediate mounting section, the free end of said bracing section having a tongue formed thereon and said supporting section having a longitudinally extending groove adjacent the free end thereof, said tongue and groove being cooperatively dimensioned and configured to provide a snap fit to interengage firmly said supporting and bracing sections in positions folded inwardly about said mounting section with said member in erected form, said supporting section and bracing section each having a plurality of spaced openings extending therethrough inwardly of the margins thereof, said openings in said bracing section being disposed to be vertically aligned in the erected form with those of said support section for individual support of each of the objects.

2. The article of claim 1 wherein each of said sections of said member is of generally rectangular peripheral configuration, and wherein said hinge elements extend generally parallel to the edges at the opposite ends of said member.

3. The article of claim 1 wherein said mounting section has means adapted for affixing said member to supporting structure.

4. The article of claim 1 wherein said member is integrally formed from a single piece of synthetic resinous material.

5. A package of objects, comprising:

a backing board;

a plurality of elongated tools with enlarged handles and shanks of smaller cross section;

a generally planar member adapted to be erected into a rack for supporting said tools, said member being divided by longitudinally spaced, laterally extending hinge elements into a supporting section, a bracing section, and an intermediate mounting section, the free end of said bracing section having a tongue formed thereon and said supporting section having a longitudinally extending groove adjacent the free end thereof, said tongue and groove being cooperatively dimensioned and configured to provide a snap fit to interengage firmly said supporting and bracing sections in positions folded inwardly about said mounting section with said member in erected form, said supporting section and bracing section each having a plurality of spaced openings inwardly of the margin thereof, said openings in said support section being of lesser dimension than said handles but of greater dimension that said shanks extending therethrough said openings in said sections being disposed to be vertically aligned in the erected form for individual support of each of the tools, said planar member and backing board lying in superposed relationship to one another, and said tools being disposed thereupon; and removable means for maintaining said board, tools and member in assembly.

6. The package of claim 5 wherein said removable means comprises a film of synthetic resinous material wrapped about said board, objects and member.

* * * * *